US005741371A

United States Patent [19]

Roggatz

[11] Patent Number: 5,741,371

[45] Date of Patent: Apr. 21, 1998

[54] METHOD AND DEVICE FOR CONTROLLING THE CO CONTENTS OF A FURNACE ATMOSPHERE FOR CARBURIZATION AND CARBONITRIDING OF METALLIC WORK PIECES

[75] Inventor: Max Roggatz, Goch, Germany

[73] Assignee: Ispen Industries International GmbH, Kleve, Germany

[21] Appl. No.: 637,328

[22] Filed: Apr. 22, 1996

[30] Foreign Application Priority Data

Apr. 22, 1995 [DE] Germany ..... 195 14 932.7

[51] Int. Cl.[6] ..... C23C 8/20; C23C 8/30

[52] U.S. Cl. ..... 148/216; 148/235; 266/251

[58] Field of Search ..... 148/216, 235; 266/251

[56] References Cited

U.S. PATENT DOCUMENTS 4,372,790 2/1983 Göhring et al. ..... 148/216

FOREIGN PATENT DOCUMENTS 0465226 1/1992 European Pat. Off. .
57-177969 11/1982 Japan .
2044804 10/1980 United Kingdom .

*Primary Examiner*—Deborah Yee
*Attorney, Agent, or Firm*—Robert W. Becker & Associates

[57] ABSTRACT

A method for controlling the CO contents of furnace atmosphere for carburizing and carbonitriding metallic workpieces in a furnace includes the step of directly feeding a mixture of an oxidizing reagent and a hydrocarbon-containing fuel into the furnace for producing a CO-containing furnace atmosphere. The CO contents of the furnace atmosphere is measured and compared to a preset minimal CO value. A CO-forming substance is introduced into the furnace atmosphere when the measured CO contents is no longer greater than the preset minimal CO value.

7 Claims, 1 Drawing Sheet

METHOD AND DEVICE FOR CONTROLLING THE CO CONTENTS OF A FURNACE ATMOSPHERE FOR CARBURIZATION AND CARBONITRIDING OF METALLIC WORK PIECES

BACKGROUND OF THE INVENTION

The present invention relates to a method for controlling the CO contents of a furnace atmosphere for carburization and carbonitriding of metallic work pieces in a furnace, whereby the furnace atmosphere is generated by directly applying a mixture of an oxidizing reagent, for example, air, and a hydrocarbon-containing fuel as well as optionally ammonia ($NH_3$) within in the furnace.

The invention relates to a device for preforming the inventive method.

In carburization or carbonitriding processes the required atmosphere for carburization is produced in a separate protective gas generator (endogas) or by supplying nitrogen with methanol to the furnace. In both methods of protective gas generation a relatively stable CO value is produced within the furnace which in the first scenario is realized with the proper adjustment of the protective gas generator and the fuel used in the protective gas generator and in the second scenario with the percentage of methanol introduced into the furnace. A third variant is the direct supply of hydrocarbon fuel and an oxidizing gas component, for example, air or $CO_2$. In this technique the liquid or gaseous fuels are mixed with the oxidizing reagent and introduced into the furnace. The CO component required for carburization within the furnace is generated by the direct reaction of the fuel with the oxygen of the oxidation component. At present natural gas and air are most commonly used in such direct supply methods. This is a result of the high availability and favorable price of natural gas.

The conversion of natural gas in the furnace with oxygen contained in the air takes place according to the following equation:

$$CH_4+0.5O_2+1.88N_2 \rightarrow CO+2H_2+1.88N_2.$$

Upon complete conversion of methane within the furnace with oxygen of the air a maximum CO contents of the furnace atmosphere of 20.5 volume % is thus obtained. This high CO contents can, however, be achieved only under ideal conditions (very high furnace temperature).

At lower furnace temperatures, especially below approximately 870° C. the above mentioned reaction is very slow and the conversion of methane to CO is thus correspondingly low.

Furthermore, the above mentioned CO formation reaction is further impaired by the presence of ammonia (required for carbonitriding).

Low CO contents have the effect that the carbon transmission is reduced and that the furnace atmosphere for carburization or carbonitriding can hardly be controlled. Furthermore, the furnace is contaminated to a great extent with carbon black. The carbon black deposition in the furnace requires production shutdown because for removal of carbon black the furnace must be shut down and the carbon black must be burned off.

It is therefore an object of the present invention to provide a method for controlling the CO contents of a furnace atmosphere which ensures a continuous and reliable operation of carburization and carbonitriding furnaces even at low carburization temperatures (smaller or equal to 870° C.) and even in the presence of ammonia (carbonitriding).

SUMMARY OF THE INVENTION

The inventive method for controlling the CO contents of a furnace atmosphere for carburizing an carbonitriding metallic workpieces in a furnace is primarily characterized by the following steps:

- directly feeding a mixture of an oxidizing reagent and a hydrocarbon-containing fuel into the furnace for producing a CO-containing furnace atmosphere;
- measuring the CO contents of the furnace atmosphere;
- comparing the measured CO contents to a preset minimal CO value;
- introducing a CO-forming substance into the furnace atmosphere when the measured CO contents is no longer greater than the preset minimal CO value.

Preferably, the step of directly feeding includes introducing ammonia into the furnace.

Advantageously, the CO-forming substance is methanol.

In a preferred embodiment of the present invention the step of comparing includes comparing the measured CO contents to a preset maximal CO value and the step of introducing is continued until the measured CO contents reaches the preset maximal CO value.

Preferably, the preset maximal CO value is 15% and the preset minimal CO value is 12%.

The present invention also relates to a device for controlling the CO contents of a furnace atmosphere according to the aforedescribed method, wherein the device is primarily characterized by:

- a CO analyzer for measuring the CO contents in the furnace atmosphere;
- a means for supplying a CO-forming substance to the furnace, the means including a valve; and
- a programmable CO controller for controlling the valve depending on the measured CO contents in the furnace atmosphere.

Preferably, the means for supplying includes a pump and the CO controller controls the pump.

The described object of providing a continuous and reliable operation of a furnace with a controlled CO contents is inventively solved by measuring the CO contents of the furnace atmosphere and, when the freely selectable preset minimal CO value of the furnace atmosphere is reached, a CO-forming substance is introduced into the furnace atmosphere. According to a preferred embodiment the CO-forming substance is methanol. The methanol introduced into the furnace atmosphere is cleaved according to the following reaction:

$$CH_3OH \rightarrow CO+2H_2.$$

This reaction takes place at furnace temperatures of above or equal to 800° C. so that the CO contents in the furnace atmosphere will again rise above the minimal CO value.

An alternative CO-forming substance is $CO_2$.

In order to maintain the amount of CO-forming substance introduced into the furnace atmosphere at a low or minimal level and to thus provide an inexpensive method, it is possible to select a maximal preset value for the CO contents so that, upon reaching this maximal preset value, the introduction of the CO-forming substance is stopped until the CO contents during the course of the carburization process is again lowered to the preset minimal CO value.

A CO contents of approximately 12% has proven to be an acceptable minimal CO value within the furnace atmosphere because below this value increased carbon black formation will result and, furthermore, the furnace atmosphere can no longer be exactly controlled. The range of CO contents between the minimal and maximal CO value is preferably between approximately 12% and 15% CO and this range has been proven to be very successful in practice. Since below the CO contents of 15% the course of the CO decrease is relatively flat, an increase of the CO contents by addition of the CO-forming substance up to the preset maximal value of approximately 15% is sufficient in order to perform the process for an extended period of time at a CO contents above the minimum value. Furthermore, this relatively narrow range makes it possible that only a minimal amount of CO-forming substance is required for raising the CO contents so the expenditure for the process is relatively low.

The device for preforming the afore described method comprises a CO analyzer for determining the CO contents within the furnace atmosphere and a programmable CO controller in order to control a valve and optionally a pump as a function of the CO contents within the furnace atmosphere. The valve and optionally the pump are turned on when the CO contents falls to the preset minimal CO value so that the CO-forming substance is introduced into the furnace. Upon reaching the preset maximal CO valve the valve is again closed, respectively, the pump is turned off to stop the supply of CO forming substance.

BRIEF DESCRIPTION OF THE DRAWINGS

The object and advantages of the present invention will appear more clearly from the following specification in conjunction with accompanying drawings, in which.

DESCRIPTION OF PREFERRED EMBODIMENTS

The present invention will now be described in detail with the aid of a specific embodiment utilizing FIGS. 1 and 2.

Figure 1:
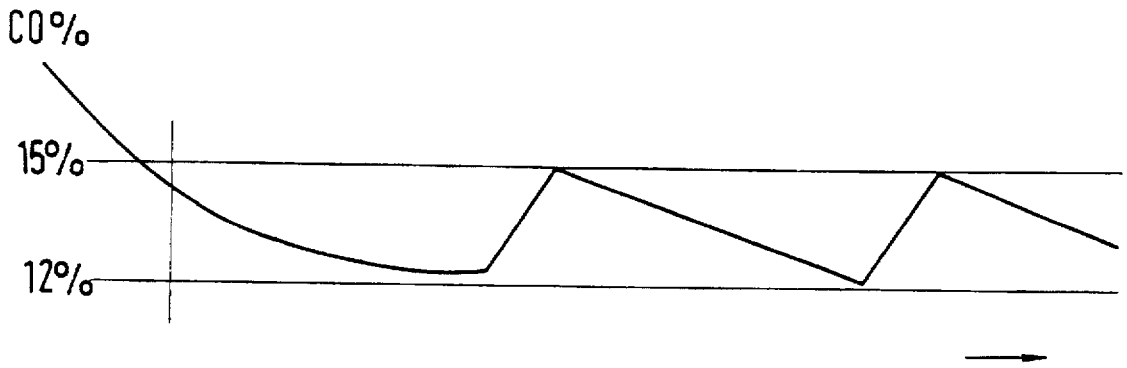
FIG. 1 shows a diagram of the course of the CO contents within the furnace atmosphere for the inventive method.

The diagram represented in FIG. 1 shows the course of the CO contents during a carbonitriding process. By addition of ammonia to the furnace atmosphere, the CO contents greatly decreases during the course of the process. As can be seen in FIG. 1, the curve of the CO contents below 15% CO is very flat. Below the minimal CO value of 12% indicated in the drawing, the CO contents will result in a fast carbon black production and deposition within the furnace. Upon reaching this lower limit, the furnace atmosphere is supplemented with a CO-forming substance, for example, methanol which, due to the high process temperatures, reacts according to the following equation:

$$CH_3OH \rightarrow CO + 2H_2.$$

Due to the CO formation resulting from the cleavage of methanol, the CO contents within the furnace atmosphere quickly increases which is represented by the steep increase of the CO curve of FIG. 1. Upon reaching a freely adjustable upper limit, in FIG. 1 a value of 15%, the methanol supply is interrupted so that the CO contents in the furnace atmosphere will again fall due to the continuously preformed process.

From FIG. 1 it can be taken that already a slight increase of the CO contents from 12% to 15% ensures for an extended period of time a reliable performance of the process above the critical limit for carbon black formation because the course of the CO curve below 15% is very flat.

Figure 2:
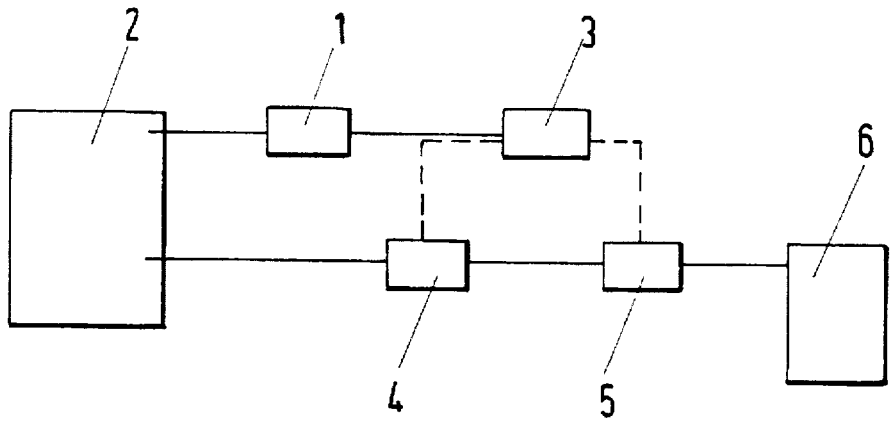
FIG. 2 shows a schematic representation of the inventive device for preforming the inventive method.

FIG. 2 shows schematically the design of a device for preforming the afore described method. With a CO analyzer 1 the CO contents of the furnace atmosphere within the furnace chamber 2 is measured. The control device further comprises a programmable CO controller 3 which is programmed with the respectively selected upper and lower CO values.

Via the control path (indicated as a dashed line) the CO controller 3 controls a valve 4 and optionally a pump 5 as soon as it is determined that the CO value measured by the CO analyzer 1 corresponds to the minimal CO value saved within the CO controller, thereby recognizing that the minimal CO value has been reached.

The pump 5 which is controlled by the CO controller 3 thus supplies the CO-forming substance from the tank 6 through the now open valve 4 into the chamber 2 of the furnace. In the furnace chamber 2 the CO forming substance is thus cleaved, as disclosed above, so that the CO contents within the furnace atmosphere is again raised. When the continuous comparison of the CO contents detected by the CO analyzer 1 with the maximal and minimal CO values stored within the CO controller 3 shows that the preset upper CO value has been reached, the valve 4 and optionally the pump 5 are shut off by the CO controller 3.

The aforedescribed process will start again as soon as with the aid of the CO analyzer 1 and the CO controller 3 it is determined again that the preset minimal CO value has been reached.

With the inventive control method it is ensured, on the one hand, that the CO contents of the furnace atmosphere will never fall below the preset minimal CO value, below which carbon black deposition within the furnace is caused, and, on the other hand, only the amount CO-forming substance is introduced into the furnace atmosphere as is required for an inexpensive and reliable operation of the process.

The present invention is, of course, in no way restricted to the specific disclosure of the specification and drawings, but also encompasses any modifications within the scope of the appended claims.

What I claim is:

1. A method for controlling CO contents of a furnace atmosphere for carburizing and carbonitriding metallic workpieces in a furnace, said method comprising the steps of:

directly feeding a mixture of an oxidizing reagent and a hydrocarbon-containing fuel into the furnace for producing a CO-containing furnace atmosphere;

measuring the CO contents of the furnace atmosphere;

comparing the measured CO contents to a preset minimal CO value;

introducing methanol into the furnace atmosphere when the measured CO contents is no longer greater than the preset minimal CO value.

2. A method according to claim 1, wherein the step of directly feeding includes introducing ammonia into the furnace.

3. A method according to claim 1, wherein the step of comparing includes comparing the measured CO contents to a preset maximal CO value and wherein said step of introducing is continued until the measured CO contents reaches the preset maximal CO value.

4. A method according to claim 3, wherein the preset maximal CO value is 15%.

5. A method according to claim 1, wherein the preset minimal CO value is 12%.

6. A device for controlling CO contents of a furnace atmosphere for carburizing and carbonitriding metallic workpieces in a furnace by directly feeding a mixture of an oxidizing reagent and a hydrocarbon-containing fuel into the furnace for producing a CO-containing furnace atmosphere, by measuring the CO contents of the furnace atmosphere, by comparing the measured CO contents to a preset minimal CO value, and by introducing methanol into the furnace atmosphere when the measured CO contents is no longer greater than the preset minimal CO value; said device comprising:

a CO analyzer for measuring the CO contents in the furnace atmosphere;

a means for supplying methanol to the furnace, said means including a valve; and a programmable CO controller for controlling said valve depending on the measured CO contents in the furnace atmosphere.

7. A method according to claim 6, wherein said means for supplying includes a pump and wherein said CO controller controls said pump.

* * * * *